US006764070B2

(12) United States Patent
Masotta et al.

(10) Patent No.: US 6,764,070 B2
(45) Date of Patent: Jul. 20, 2004

(54) PATHLENGTH COMPENSATION METHOD AND DEVICE FOR HIGH SPEED SHEET CUTTERS

(75) Inventors: John R. Masotta, Bethel, CT (US); Gregory P. Skinger, Southbury, CT (US); John W. Sussmeier, Cold Spring, NY (US); William J. Wright, Killingworth, CT (US)

(73) Assignee: PitneyBowes Inc., Stamford, CT (US)

( * ) Notice: Subject to any disclaimer, the term of this patent is extended or adjusted under 35 U.S.C. 154(b) by 28 days.

(21) Appl. No.: 10/280,382

(22) Filed: Oct. 25, 2002

(65) Prior Publication Data

US 2004/0080097 A1 Apr. 29, 2004

(51) Int. Cl.[7] ..... B65H 3/44; B65H 5/26

(52) U.S. Cl. ..... 271/9.13; 271/9.12; 400/584

(58) Field of Search ..... 271/9.1, 9.12, 271/9.13; 221/131; 400/611, 619, 584; B65H 3/44, 5/26

(56) References Cited

U.S. PATENT DOCUMENTS 5,415,385 A * 5/1995 Newsome et al. ..... 270/58.25
6,443,447 B1 * 9/2002 Ifkovits et al. ..... 271/225
6,659,445 B2 * 12/2003 Boss ..... 271/9.13

FOREIGN PATENT DOCUMENTS

JP 2-204237 * 8/1990 ..... B65H/3/44

* cited by examiner

*Primary Examiner*—Donald P. Walsh
*Assistant Examiner*—Kenneth W Bower
(74) *Attorney, Agent, or Firm*—Michael J. Cummings; Charles R. Malandra, Jr.; Angelo N. Chaclas

(57) ABSTRACT

A method and system for sheet accumulating wherein a web of material is cut into groups of cut sheets and a right-angle transport device is used to collate the cut sheets into packets. Because the cut sheets in each packet are moved into and out of the right-angle transport device in separate paths with different pathlengths, the cut sheets overlap with each other by an overlapped amount as they exit the right-angle transport device. A path deflector having a curved path is used in at least one of the paths in order to reduce the pathlength difference, thereby increasing the overlapped amount.

12 Claims, 8 Drawing Sheets

PATHLENGTH COMPENSATION METHOD AND DEVICE FOR HIGH SPEED SHEET CUTTERS

TECHNICAL FIELD

The present invention relates generally to a sheet accumulating system and, more particularly, to a sheet accumulating system that uses a continuous web cutter for providing cut sheets and a right-angle transport device for stacking the cut sheets.

BACKGROUND OF THE INVENTION

Continuous web cutters are known in the art. A typical continuous web cutter is shown in FIG. 1. FIG. 1 shows a mass mailing insertion machine 1, which uses a continuous web cutter 10 to cut a continuous web of material 20 into cut sheets, and provide the cut sheets to a sheet accumulator 60 via a right-angle transport device 50. The cut sheets are accumulated into stacks in the sheet accumulator 60 and the stacks are inserted into envelopes in an envelope insertion station 70. As shown in FIG. 1, a continuous web of material 20 with sprocket holes on both side of the web 20 is fed from a fan-fold stack 18 into the web cutter 10, which has two moving belts with sprockets 12 (or tractors with pins) to move the web 20 toward a guillotine cutting module 16 for cutting the web 20 cross-wise into separate sheets. Perforations 30 (see FIG. 2*a*) are provided on each side of the web material 20 so that the sprocket hole sections of the web 20 can be removed from the sheets prior to moving the cut sheets to other components of the mailing insertion machine 1. In particular, the continuous web cutter 10, as shown in FIG. 1, is used to feed two webs 22, 24 of material linked by a center perforation 26. As shown, a splitter 14 is used to split the linked webs 22, 24 into two separate webs before the webs can be simultaneously cut by the cutting module 16 into two cut sheets 42, 44, as shown in FIG. 2*a*. This type of web cutter is also known as a 2-up cutter. As shown in FIG. 2*a*, the sheets 42, 44 are moved substantially along a direction 102 toward a right-angle transport device 50 so that both sheets are moved along the same line in a different direction 104 as they exit the right-angle transport device 50.

Right angle transport devices are known in the art. For example, Auerbach et al. (U.S. Pat. No. 5,664,772) discloses a right-angle transport device having two or more sheet turn-over modules, wherein the turn-over modules are placed at 45 degrees in the path of two or more sheets moving in a side-by-side fashion so that these sheets are turned over while their moving direction is changed by 90 degrees. Two turn-over modules 52, 54 are shown in FIG. 2*a*. Before encountering the turn-over modules 52, 54, the cut sheets 42 and 44 are moving side-by-side at the same speed, with their leading edges 142, 144 substantially in-step with each other. However, after emerging from the turn-over modules 52, 54, as shown in FIGS. 3*d* and 3*e*, the cut sheet 42 leads the cut sheet 44 by a distance D. This is because the two cut sheets 42, 44 travel on two different paths. As shown in FIG. 2*b*, the cut sheet 42 travels on a shorter inner path 112, while the cut sheet 44 travels on a longer outer path 114. The length of the outer path 114 (from X' to M) is greater than the length of the inner path 112 (from X to M) by a distance OM, which is substantially equal to D.

FIGS. 3*a* to 3*e* illustrate how the turn-over modules 52, 54 are used to change the direction of the cut sheets 42, 44 so that they are moving substantially in the same path 116, with one sheet leading another in an overlapping manner. As shown in FIG. 3*a*, sheets 42, 44 move at the same speed 106 toward the turn-over modules 52, 54 along the first direction 102. The length of the sheets 42, 44 is denoted by the letter L and the width is denoted by the letter W. As shown in FIG. 3*b*, part of the sheets 42, 44 are turned over by the turn-over modules 52, 54 and the turned over sections move along the second direction 104, which is substantially perpendicular to the first direction 102. FIG. 3*c* shows that the sheets 42 and 44 are further engaged with the turn-over modules 52, 54. Because they move at the same speed 106, the sheets 42, 44 are turned over by the same amount. As the sheets 42, 44 emerge from the turn-over modules 52, 54, they move substantially on the same line along the second direction 104 with the inner cut sheet 42 leading the outer cut sheet 44. The sheets are partially overlapped with each other by an amount S, as shown in FIG. 3*d*. The overlapped amount S is substantially equal to the difference between L and W. When the sheets 42, 44 are completely disengaged from the turn-over modules 52, 54, they are overlapped by the same amount S, as shown in FIG. 3*e*, if they are not moved by another moving mechanism in a different way.

The partially overlapped sheets 42, 44 form a 2-sheet packet. The overlapped amount in this 2-sheet packet is essential for collation in the sheet accumulator 60. If the difference between the length L and the width W of the sheets is very small, the small overlapped amount of the two cut sheets may cause a paper jam. If the width W is equal to or greater than L, then the sheets do not overlap with each other after they emerge from the turn-over modules 52, 54, which can cause problems in collation.

In order to achieve a desirable overlapped amount in a 2-sheet packet, Ifkovits et al. (U.S. Pat. No. 6,443,447) uses rollers of different speeds to separately drive the two cut sheets 42, 44 toward the turn-over modules 52, 54. More specifically, the driving speed for the inner cut sheet 42 is lower than the driving speed for the outer cut sheet 44. The use of different speeds would complicate the design of the mass mailing insertion machine because motors of different speeds are needed. Use of different speed motors in a higher velocity system is impractical because significant path length must be added to both paths in order to provide the design overlap.

Furthermore, in a mass mailing insertion machine, as shown in FIG. 1, the collation of sheets in the accumulator 60 requires that a minimum allowable gap is provided between two consecutive packets. The minimum allowable gap is determined by the time required for the trailing edge of the preceding packet to settle in the accumulator before the leading edge of the following packet arrives. The gap between consecutive packets is mainly determined by the cutter rate of the web cutter 10 and the moving speed of the cut sheets. In a machine, as disclosed in Ifkovits et al., if the speed for the inner path is 121 ips (inch per second) and the speed for the outer path is 144 ips, the inter-packet gaps at different cutter rates can be calculated as follows:

| Cutter rate (thousand per hour) | Gap (inches) | Gap (milliseconds) |
|---|---|---|
| 25 | 4.34 | 30 |
| 27 | 2.79 | 19 |
| 30 | 0.86 | 6 |
| 36 | −2.04 | −14 |

Depending on an accumulator's design, it is generally desirable to have a minimum allowable gap of 2.94 inches or 20 ms between two consecutive packets. This gap is calculated by assuming that the sheets attain their velocity after they are cut by the cutting module 16 and driven by nips in the right-angle transport device 50. Without the speed differential, the resulting gap for a 25K cutter operated at 144 ips would be 1.38 in (10 ms). In practice, the gap is somewhat non-deterministic due to the soft nips used in the web cutter and in the right-angle transport device. At any rate, while the machine as disclosed in Ifkovits et al. increases the inter-packet gap and helps solve the problem regarding the overlapped amount between two sheets in a packet, it is difficult to achieve a minimum allowable gap beyond the cutter rate of 27K.

It is advantageous and desirable to provide a method and device for increasing the overlapped amount of the cut sheets as they exit the right-angle transport device and, at the same time, increasing the inter-packet gap as the packets arrive in an accumulator.

SUMMARY OF THE INVENTION

It is a primary objective of the present invention to increase the overlapped amount of cut sheets in a sheet packet as they exit a right-angle transport device. If so desired, the overlapped amount in the sheet packet can be increased so that they are totally overlapped with each other such that the leading edge of one sheet is substantially in-step with the leading edge of another. It is another objective of the present invention to achieve a desirable inter-packet gap in the accumulator of a mass mailing insertion machine while increasing the cutter rate. These objectives can be achieved by compensating the pathlength of one or more cut sheets between the cutter module of the web cutter and the turn-over modules of the right-angle transport device.

Thus, according to the first aspect of the present invention, there is provided a path deflection device to be used in a sheet accumulating system. The system comprises:

a continuous web cutter for cutting a continuous web of material into groups of cut sheets, each group of cut sheets comprising at least a first sheet and a second sheet moving substantially side-by-side along a first direction, wherein the first sheet moves in a first path and the second sheet moves in a second path substantially equal to the first path in length; and a right angle transport device for changing the moving direction of the sheets from the first direction to a second direction substantially perpendicular to the first direction, such that the first and second sheets move in a same path in the second direction, with the second sheet traversing an additional path in the second direction, causing the first sheet to lead the second sheet in the second direction in an overlapping manner with an overlapped amount. The path deflection device comprises:

a channel having an entrance point and an exit point, disposed in the first path such that the entrance point is located at a first point of the first path and the exit point is located at a second point of the first path; and a deflection mechanism disposed at the entrance point of the channel for causing the first sheet to deviate from the first path at the first point, to move through the channel and exit the channel at the exit point so that the first sheet continues to move in the first path from the second point toward the right angle transport device, wherein the channel has a channel length greater than the distance between the first point and the second point of the first path so as to compensate for the additional path traversed by the second sheet in the second direction, thereby increasing the overlapped amount.

Advantageously, the first and second sheets have a width and a length, the length substantially parallel to the first and second paths, wherein the difference between the channel length and the distance between the first point and the second point of the first path is substantially equal to or small than the width of the first and second sheets.

According to the second aspect of the present invention, there is provided a method of sheet accumulation. The method comprises the steps of:

cutting a web of material into groups of cut sheets, wherein each group of cut sheets comprises at least a first sheet and a second sheet moving substantially side-by-side along a first direction, wherein the first sheet moves in a first path and the second sheet moves in a second path substantially equal to the first path in length;

changing the moving direction of the sheets from the first direction to a second direction substantially perpendicular to the first direction, such that the first and second sheets move in a same path in the second direction, with the second sheet traversing an additional path in the second direction, causing the first sheet to lead the second sheet in the second direction in an overlapping manner with an overlapped amount; and increasing the first path in order to compensate for the additional path traversed by the second sheet in the second direction, thereby increasing the overlapped amount.

Advantageously, the first pathlength is increased by a path deflection device having a curved path disposed in the first path for replacing a section of the first path, wherein the curved path has a deflection pathlength and the replaced section has a section length smaller than the deflection pathlength or substantially equal to the width of the first and second sheets.

Advantageously, the first and second sheets have a width and a length, the length substantially parallel to the first and second paths, wherein the difference between the deflection pathlength and the section length is smaller than or equal to the width of the first and second sheets.

According to the third aspect of the present invention, there is provided a sheet accumulating system. The system comprises:

a continuous web cutter for cutting a continuous web of material into groups of cut sheets, each group of cut sheets comprising at least a first sheet and a second sheet moving substantially side-by-side along a first direction, wherein the first sheet moves in a first path and the second sheet moves in a second path substantially equal to the first path in length;

a right angle transport device for changing the moving direction of the sheets from the first direction to a second direction substantially perpendicular to the first direction, such that the first and second sheets move in a same path in the second direction, with the second sheet traversing an additional path in the second direction, causing the first sheet to lead the second sheet in the second direction in an overlapping manner with an overlapped amount; and a path deflection device, disposed in the first path, for compensating for the additional path traversed by the second sheet in the second direction, thereby increasing the overlapped amount.

The present invention will become apparent upon reading the description, taken in conjunction with FIGS. 4*a*–7*c*.

BEST MODE TO CARRY OUT THE INVENTION

Figure 4A:
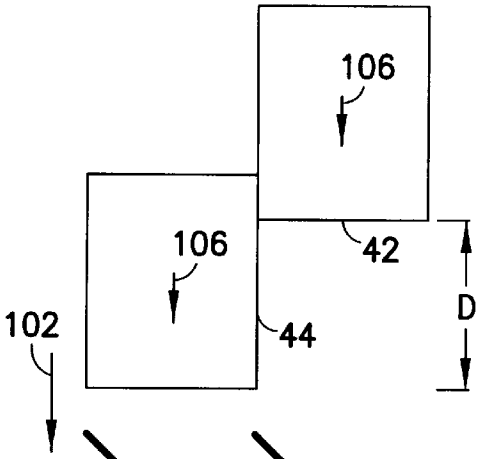
FIG. 4*a* is a schematic representation showing two cut sheets moving toward the right angle transport device at the same speed with the inner cut sheet having a headstart position.
Figure 4B:
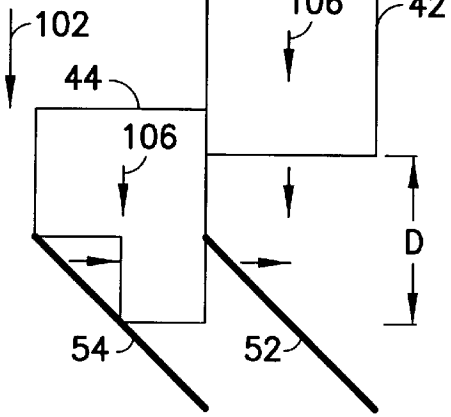
FIG. 4*b* is a schematic representation showing the same cut sheets engaged with the right-angle transport device.
Figure 4C:
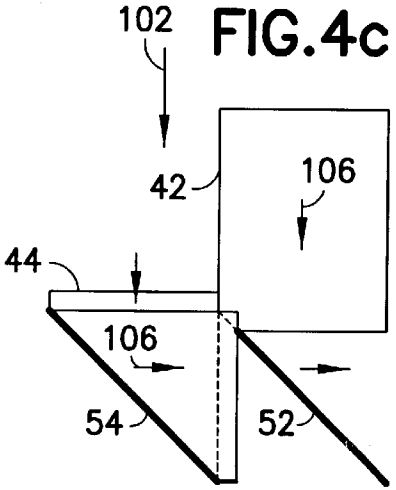
FIG. 4*c* is a schematic representation showing the same cut sheets further engaged with the right-angle transport device.
Figure 4D:
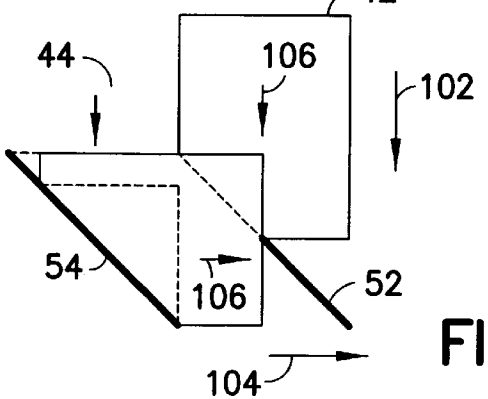
FIG. 4*d* is a schematic representation showing the overlapping of the two cut sheets at their leading edge as the sheets emerge from the right-angle transport device.
Figure 4E:
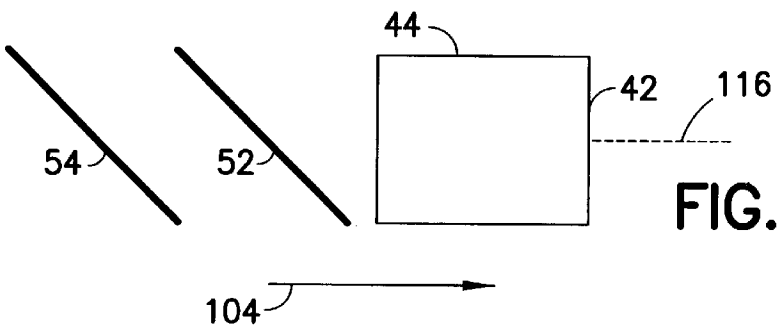
FIG. 4*e* is a schematic representation showing the two sheets totally overlapping with each other as they exit the right-angle transport device.

In theory, one way to increase the overlapped amount on the cut sheets is to give the sheet on the outer path a head start because it travels a longer distance. As shown in FIG. 4*a*, the outer cut sheet 44 is positioned ahead of the inner cut sheet 42 by a distance D before they encounter the right angle transport device 50. As such, the sheets 42, 44 engage with the turn-over modules 52, 54 at different times, as shown in FIGS. 4*b* to 4*d*. As both sheets emerge from the turn-over modules 52, 54, their turned-over sections will align with each other, as can be seen in FIGS. 4*c* and 4*d*. Together, the turn-over modules 52, 54, function as a collation device. By the time the sheets 42, 44 exit from the right-angle transport device 50, they totally overlap with each other, as shown in FIG. 4*e*. It should be noted that the term "head start" in this context simply means that the outer sheet 44 is given an advantageous starting position so that it will reach the corresponding turn-over module 54 ahead of the inner sheet 42, although both sheets move at the same time with the same speed.

Figure 1:
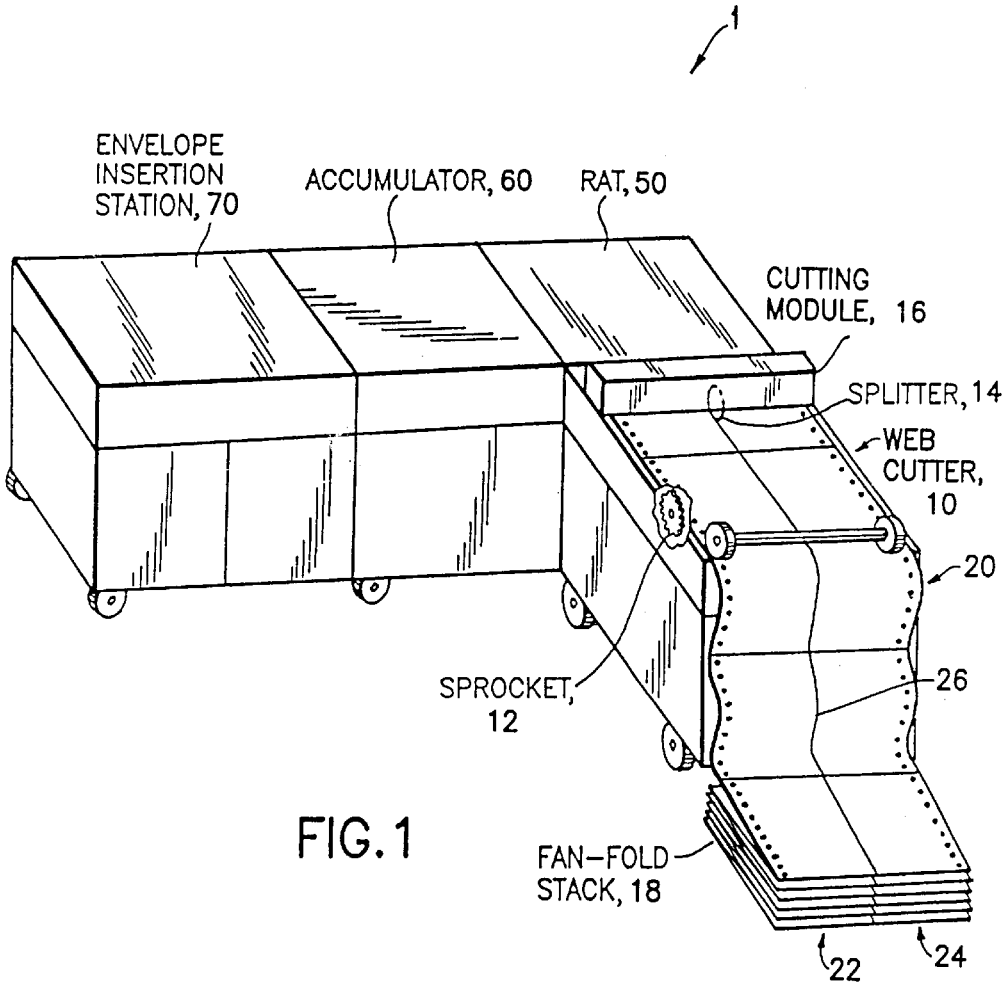
FIG. 1 is a perspective view of a typical mass mailing insertion machine using a continuous web cutter to cut a web of material into separate sheets.
Figure 2A:
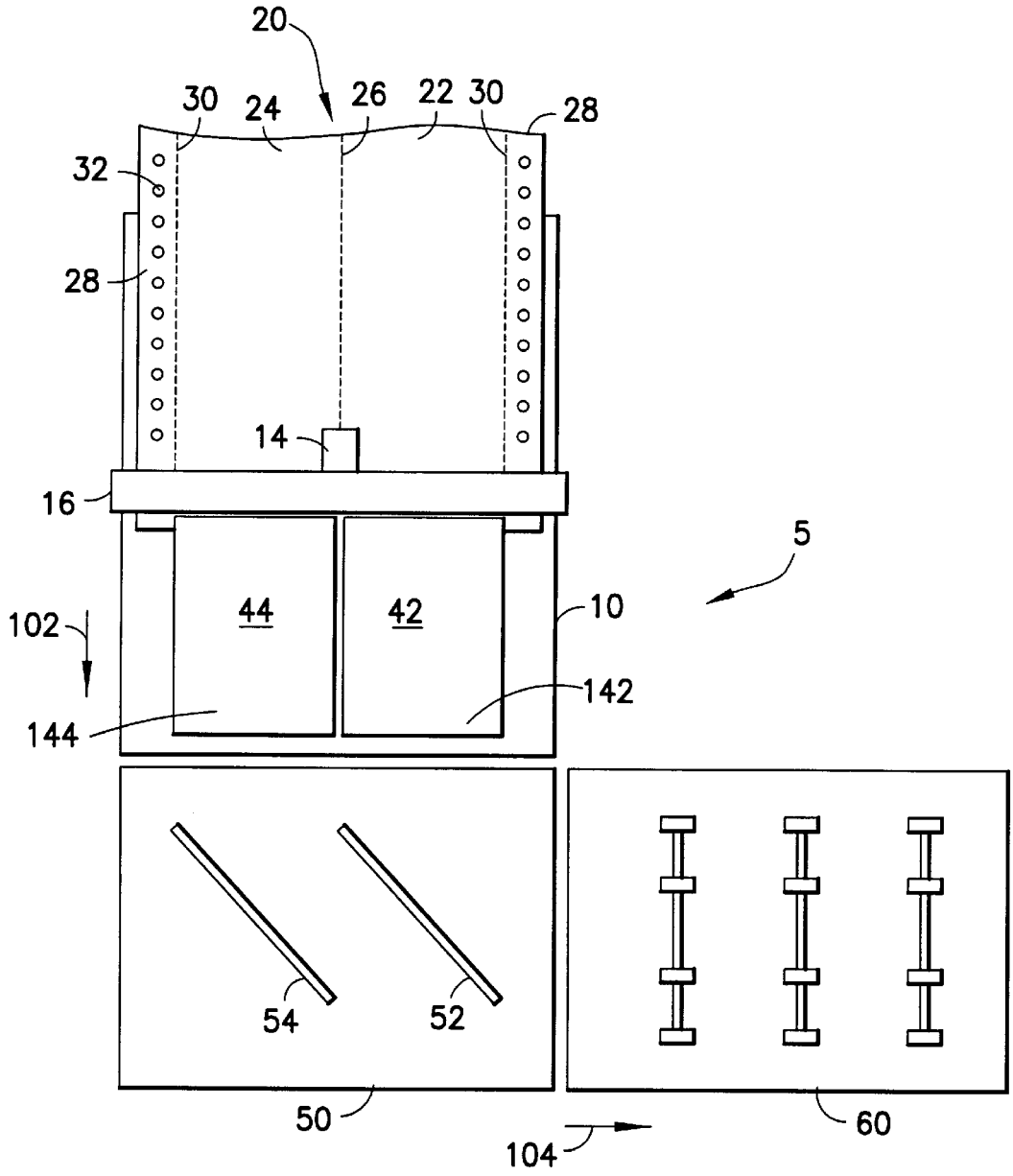
FIG. 2*a* is a schematic representation showing the top view of sheet accumulating system comprising a continuous web cutter, a right-angle transport device and a sheet accumulator.
Figure 2B:
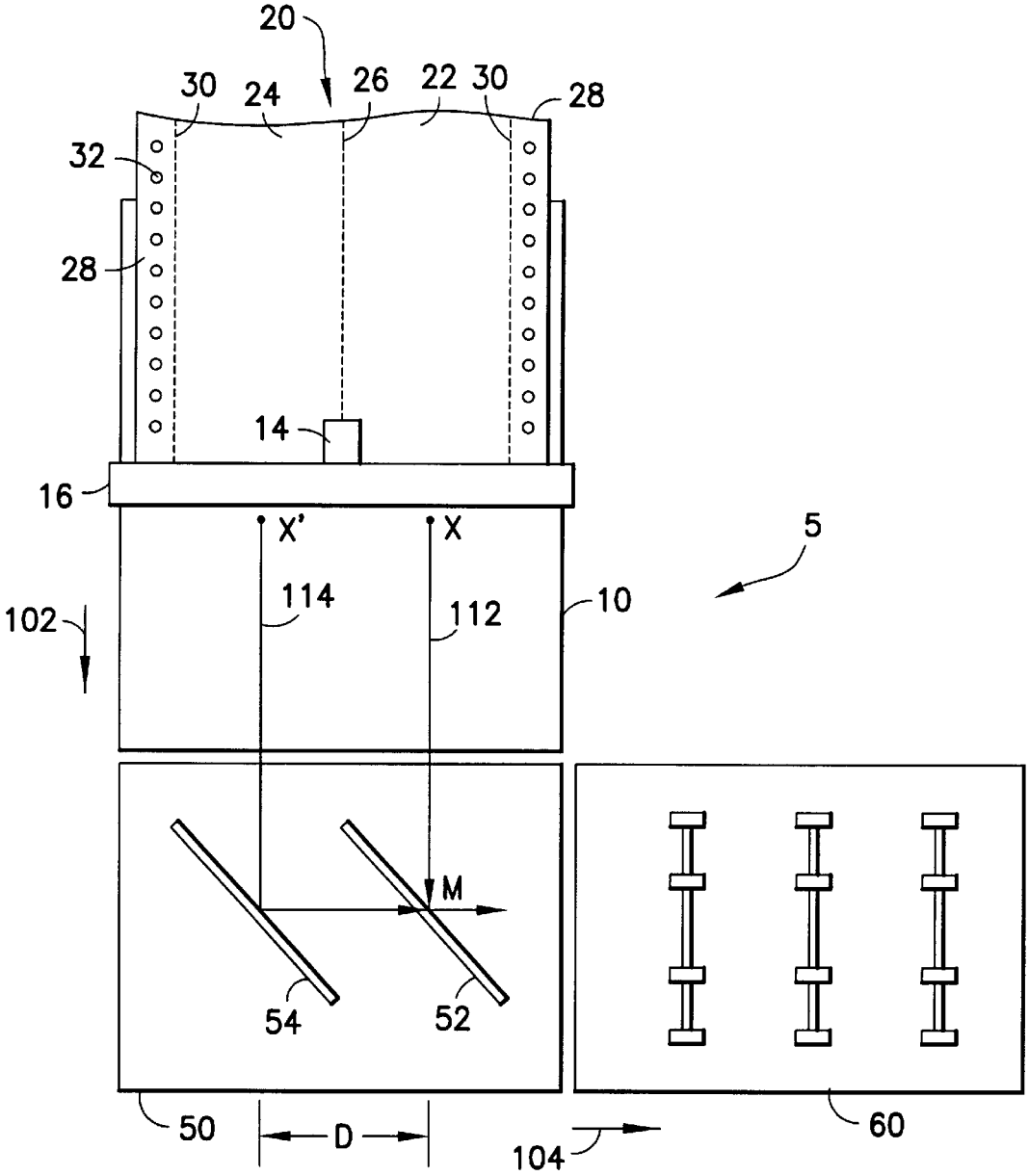
FIG. 2*b* is a schematic representation showing the path of the cut sheets in the sheet accumulating system.
Figure 3A:
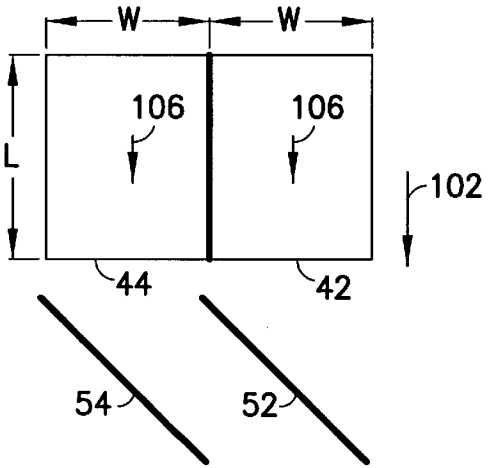
FIG. 3*a* is a schematic representation showing the position of two cut sheets moving toward the right angle transport device at the same speed after exiting the web cutter.
Figure 3B:
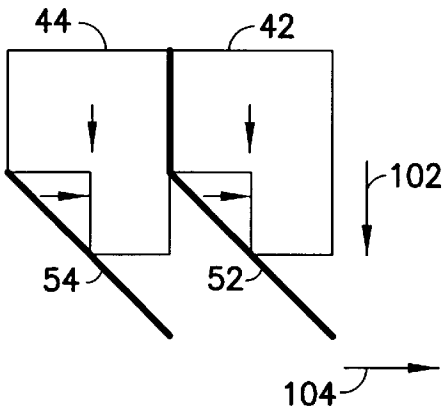
FIG. 3*b* is a schematic representation showing the position of two cut sheets engaged with the right-angle transport device.
Figure 3C:
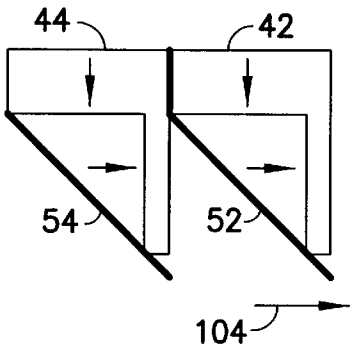
FIG. 3*c* is a schematic representation showing the position of two cut sheets further engaged with the right-angle transport device.
Figure 3D:
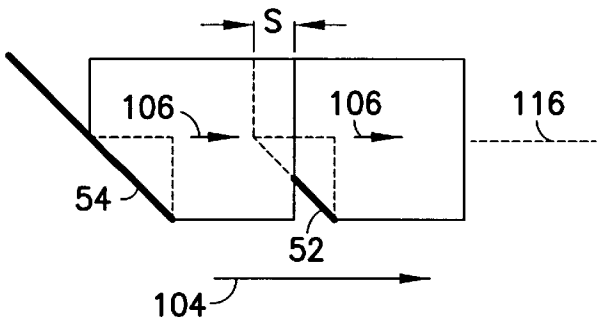
FIG. 3*d* is a schematic representation showing the overlapping of two cut sheets as they exit the right-angle transport device.
Figure 3E:
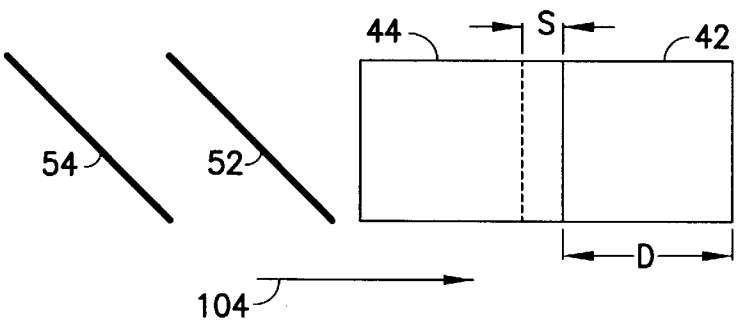
FIG. 3*e* is a schematic representation showing the two overlapped sheets after they have disengaged from the right-angle transport device.
Figure 5A:
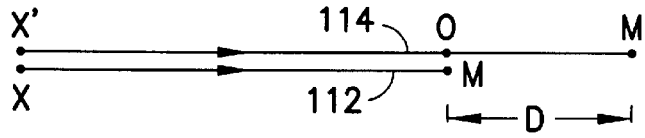
FIG. 5*a* is a schematic representation showing the difference between the inner pathlength and the outer pathlength.
Figure 5B:
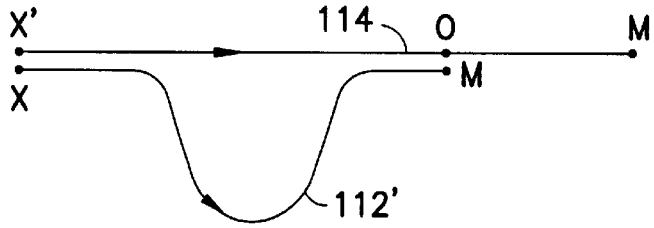
FIG. 5*b* is a schematic representation showing the pathlength compensation scheme, according to the present invention.

The pathlength compensation method, according to the present invention, gives the outer cut sheet an advantageous starting position by extending the length of the inner path 112 (see FIG. 2*b* for the inner path before pathlength extension). If so desired, the inner path 112 can be extended so that it is equal to the inner path 114 in length. The pathlength compensation scheme, according to the present invention, is illustrated in FIGS. 5*a* and 5*b*. Before pathlength compensation, the length of the outer path 114 is greater than the length of the extended inner path 112 by a distance D, as shown in FIG. 5*a*. After pathlength compensation, the length of the inner path 112' and that of the outer path 114 are substantially equal (as shown in FIG. 5*b*). As such, the outer sheet 44 reaches the turn-over module 54 before the inner sheet 42 reaches the turn-over module 52, although they move toward the respective turn-over modules at the same time with the same speed.

Figure 5C:
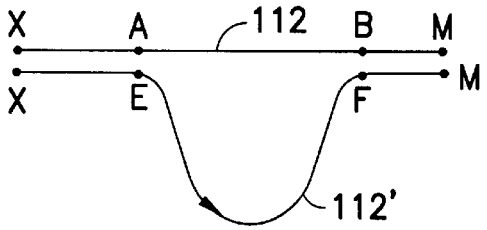
FIG. 5*c* is a schematic representation showing a section of the inner path being replaced by a curved path in order to increase the pathlength of the inner path.

Thus, the pathlength compensation scheme, according to the present invention, is the replacement of a straight path by a curved path between two points while maintaining the original moving direction of the sheet after the sheet emerges from the curved path. As shown in FIG. 5*c*, a curved section from E to F of the path 112' is used to replace a section from A to B of the path 112 in order to compensate for the additional path OM traversed by the sheet 44 and to effectively increase the pathlength from X to M. The extension of the inner path 112 can be realized by adding to the traveling path of the cut sheet 42 a paper-path tube 122 that deflects the cut sheet 42 from the existing horizontal paper path.

Figure 6:
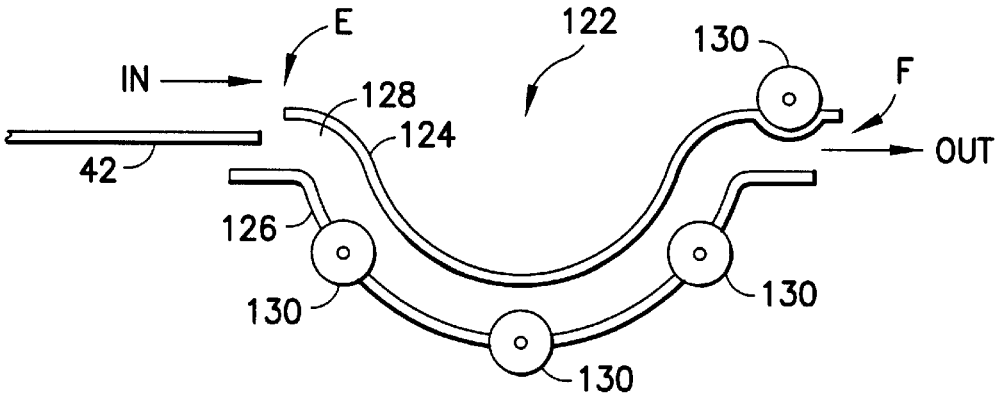
FIG. 6 is a schematic representation showing a paper path tube for extending the inner pathlength.

A schematic representation of the paper-path tube 122 is shown in FIG. 6. As shown, the paper-path tube 122 comprises an upper paper guide 124 and a lower paper guide 126 forming a channel 128 therebetween so as to force the cut sheet 42 to go a greater distance. As shown in FIG. 6, the sheet 42 is deflected by the upper paper guide 124 at the entrance point E and caused to deviate from the original path 112 at point A (See FIG. 5*c*) and enter the channel 128. If the paper guides 124, 126 do not reduce the speed of the cut sheet 42, then there is no need to use an additional driving mechanism to move the cut sheet 42 through the channel 128. Otherwise, a plurality of driving rollers 130 can be used to maintain the speed of the cut sheet 42 within the paper-path tube 122. When the sheet 42 emerges from the exit point F of the channel 128, it resumes moving in the original path 112 from point B toward point M (See FIG. 5*c*). The orientation of the paper tube 122 can be upward or downward. This means that the extended inner path 112' can be positioned above or below the existing horizontal inner path 112.

Figure 7A:
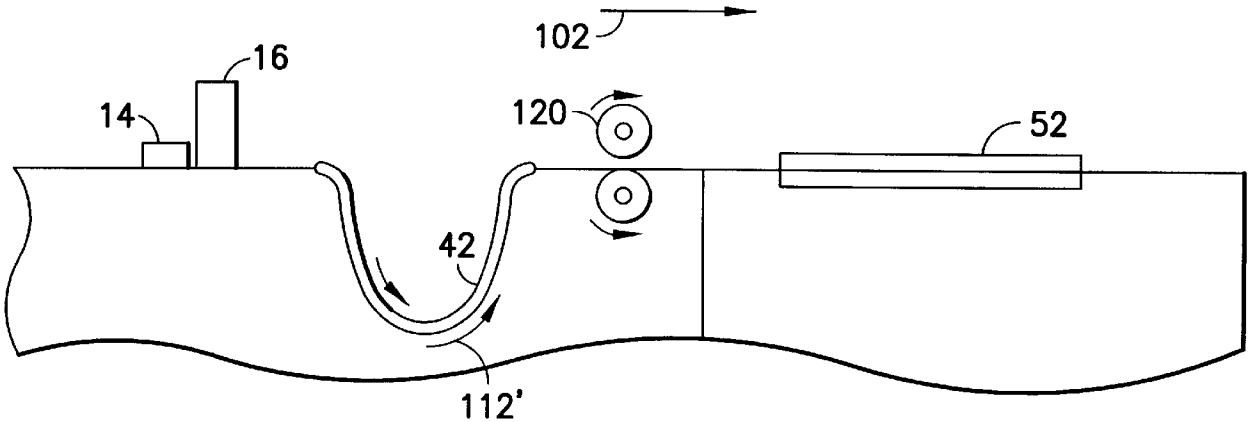
FIG. 7*a* is a schematic representation showing the length of the inner path extended in the pathlength compensation scheme, according to the present invention.
Figure 7B:
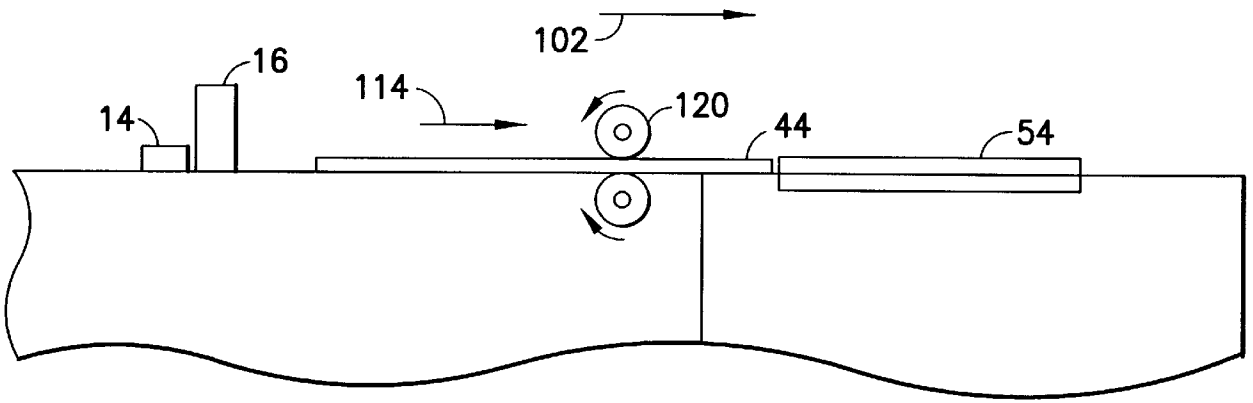
FIG. 7*b* is a schematic representation showing the outer path.
Figure 7C:
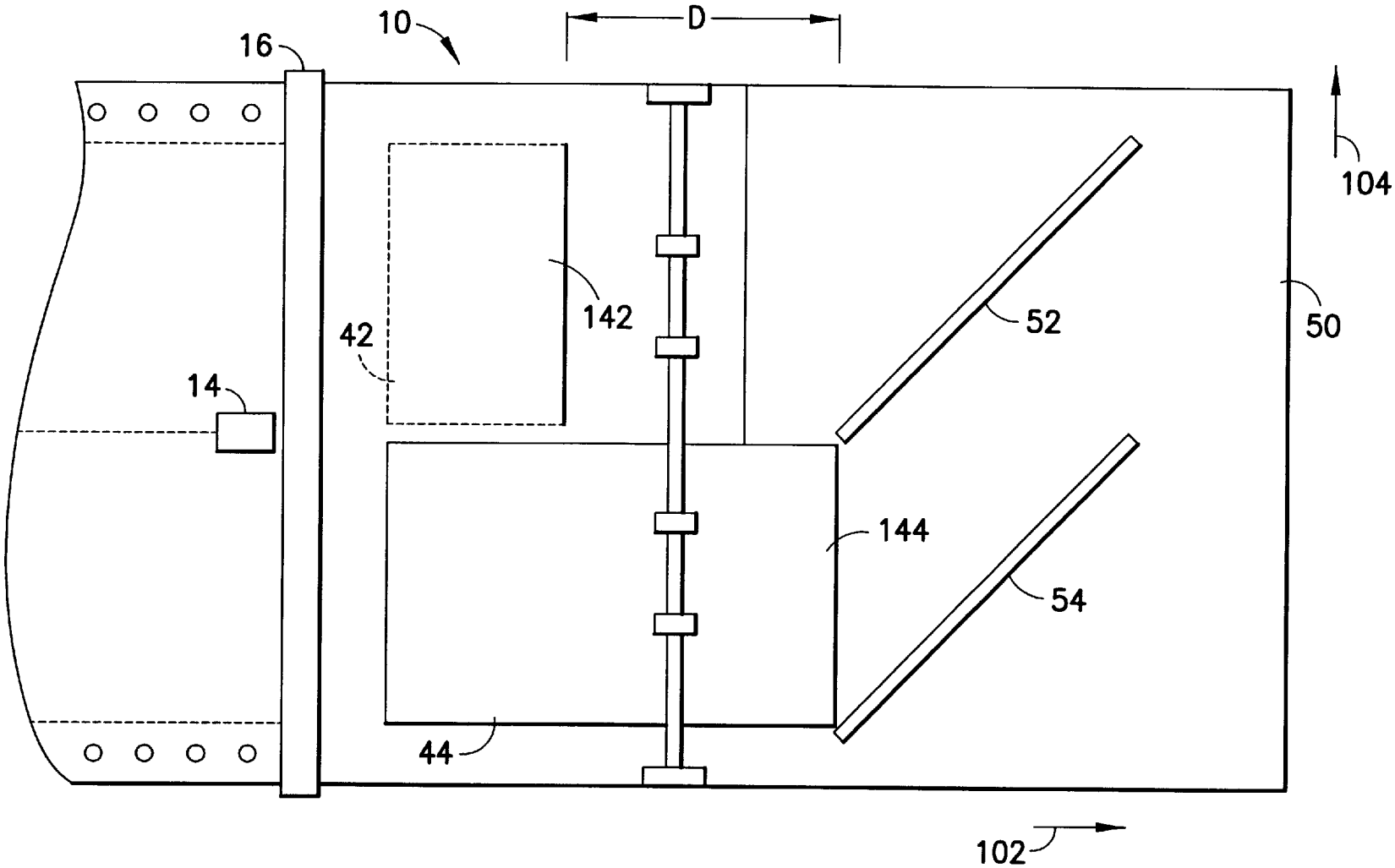
FIG. 7*c* is a schematic representation showing the top view of sheet accumulating system wherein the cut sheet on the inner path is given a head start by extending the length of the inner path.

FIG. 7*a* illustrates the traveling path of the inner cut sheet 42, extended by a downward-oriented paper path, similar to the paper-path tube 122. In comparison, the traveling path of the outer cut sheet 44 is straight and horizontal, as shown in FIG. 7*b*. As shown in FIG. 7*c*, because of the pathlength compensation, the leading edge 142 of the inner cut sheet 42 lags behind the leading edge 144 of the outer cut sheet 44. Effectively, the extended pathlength 112' gives the outer cut sheet 44 an advantageous starting position, similar to the situation as depicted in FIG. 4*a*.

With the pathlength compensation method, according to the present invention, both the inner cut sheet 42 and the outer cut sheet 44 in a 2-sheet packet can be made completely or substantially overlapped.

If the inner cut sheet 42 and the outer cut sheet 44 are allowed to completely overlap with each other by making both paper path lengths equal from the cutting module 16 to the exit end of the right-turn transport device 50, this effectively puts both cut sheets 42, 44 in a 2-sheet packet to be cut together in the same cutting cycle, one on top of another. If the length of the sheets is 11 inches and the sheets are moving at a speed of 144 ips, an inter-packet gap is achievable with a cutter rate of 36K/hr. Furthermore, the present invention simplifies the control logic of the web cutter 16, especially when this type of 2-up cutter (for cutting two webs of material linked by a center perforation) is used for half-cutting the web. For example, at 36K cuts/hr, the period between two consecutive 2-sheet packets is 100 ms. By compensating the pathlength without changing the speed of the cut sheets between the cutter module of the web cutter and the exit end of the right-angle transport device, the minimum time between individual half-cuts is always 100 ms, regardless of whether the sheet is on the inner or outer path. This effectively eliminates the parameter referred to as "tongue delay", which is the additional time delay added between collations that are side-by-side on the web for an uncompensated system.

Advantageously, the effective length of the paper path tube 122 can be adjusted according to the difference between the length L and the width W of the cut sheets 42, 44. Alternatively, the effective length of the paper path tube 122 is fixed such that there is always a slight offset between the two sheets in a 2-sheet packet while maintaining a minimum allowable gap between two consecutive packets. It can be designed that, for all specified sheet widths, a slight offset is allowed such that the inner sheet 42 is always slightly more downstream than the outer sheet 44, or the leading edge 142 is slightly ahead of the leading edge 144 when exiting the right angle transport device for all specified sheet widths.

The present invention has been disclosed as a pathlength compensation method in a sheet accumulating system, wherein a continuous web cutter is used to cut two webs into groups of two sheets, and the two sheets in any group move substantially side-by-side along the same direction. It should be noted, however, that the present invention is also applicable to a sheet accumulating system, wherein a continuous web cutter is used to cut three or more webs into groups of three or more sheets, and the sheets in any group move in a substantially side-by-side manner. In the case of three or more webs, only the outermost sheet would have a horizontal path, while the inner sheets would have progressively longer compensated paths.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A path deflection device to be used in a sheet accumulating system, the system comprising:

a continuous web cutter for cutting a continuous web of material into groups of cut sheets, each group of cut sheets comprising at least a first sheet and a second sheet moving substantially side-by-side along a first direction, wherein the first sheet moves in a first path and the second sheet moves in a second path substantially equal to the first path in length; and a right angle transport device for changing the moving direction of the sheets from the first direction to a second direction substantially perpendicular to the first direction, such that the first and second sheets move in a same path in the second direction, with the second sheet traversing an additional path in the second direction, causing the first sheet to lead the second sheet in the second direction in an overlapping manner with an overlapped amount, said path deflection device comprising:

a channel having an entrance point and an exit point, disposed in the first path such that the entrance point is located at a first point of the first path and the exit point is located at a second point of the first path; and a deflection mechanism disposed at the entrance point of the channel for causing the first sheet to deviate from the first path at the first point, to move through the channel and exit the channel at the exit point so that the first sheet continues to move in the first path from the second point toward the right angle transport device, wherein the channel has a channel length greater than the distance between the first point and the second point of the first path so as to compensate for the additional path traversed by the second sheet in the second direction, thereby increasing the overlapped amount.

2. The path deflection device of claim 1, wherein the first and second sheets have a width and a length, the length substantially parallel to the first and second paths, and wherein the difference between the channel length and the distance between the first point and the second point of the first path is substantially equal to the width of the first and second sheets.

3. The path deflection device of claim 1, wherein the first and second sheets have a width and a length, the length substantially parallel to the first and second paths, and wherein the difference between the channel length and the distance between the first point and the second point of the first path is smaller than the width of the first and second sheets.

4. A method of sheet accumulation comprising the steps of:

cutting a web of material into groups of cut sheets, wherein each group of cut sheets comprises at least a first sheet and a second sheet moving substantially side-by-side along a first direction, wherein the first sheet moves in a first path and the second sheet moves in a second path substantially equal to the first path in length;

changing the moving direction of the sheets from the first direction to a second direction substantially perpendicular to the first direction, such that the first and second sheets move in a same path in the second direction, with the second sheet traversing an additional path in the second direction, causing the first sheet to lead the second sheet in the second direction in an overlapping manner with an overlapped amount; and increasing the first path in order to compensate for the additional path traversed by the second sheet in the second direction, thereby increasing the overlapped amount.

5. The method of claim 4, wherein the first pathlength is increased by a path deflection device having a curved path disposed in the first path for replacing a section of the first path, wherein the curved path has a deflection pathlength and the replaced section has a section length smaller than the deflection pathlength.

6. The method of claim 5, wherein the first and second sheets have a width and a length, the length substantially parallel to the first and second paths, and wherein the difference between the deflection pathlength and the section length is substantially equal to width of the first and second sheets.

7. The method of claim 5, wherein the first and second sheets have a width and a length, the length substantially parallel to the first and second paths, and wherein the difference between the deflection pathlength and the section length is smaller than the width of the first and second sheets.

8. A sheet accumulating system comprising:

a continuous web cutter for cutting a continuous web of material into groups of cut sheets, each group of cut sheets comprising at least a first sheet and a second sheet moving substantially side-by-side along a first direction, wherein the first sheet moves in a first path and the second sheet moves in a second path substantially equal to the first path in length;

a right angle transport device for changing the moving direction of the sheets from the first direction to a second direction substantially perpendicular to the first direction, such that the first and second sheets move in a same path in the second direction, with the second sheet traversing an additional path in the second direction, causing the first sheet to lead the second sheet in the second direction in an overlapping manner with an overlapped amount; and a path deflection device, disposed in the first path, for compensating for the additional path traversed by the second sheet in the second direction, thereby increasing the overlapped amount.

9. The system of claim 8, wherein the path deflection device has a curved path having a deflection pathlength to replace a section of the first path, the replaced section having a section length smaller than the deflection pathlength.

10. The system of claim 9, wherein the first and second sheets have a width and a length, the length substantially parallel to the first and second paths, and wherein the difference between the deflection pathlength and the section length is substantially equal to width of the first and second sheets.

11. The system of claim 9, wherein the first and second sheets have a width and a length, the length substantially parallel to the first and second paths, and wherein the difference between the deflection pathlength and the section length is smaller than the width of the first and second sheets.

12. The system of claim 9, wherein the path deflection device has a channel defining the curved path so as to allow the first sheet to travel through the channel instead of the replaced section of the first path.

* * * * *